US007038177B2

(12) United States Patent
Rock

(10) Patent No.: US 7,038,177 B2
(45) Date of Patent: May 2, 2006

(54) ELECTRIC HEATING/WARMING FABRIC ARTICLES

(75) Inventor: Moshe Rock, Brookline, MA (US)

(73) Assignee: Malden Mills Industries, Inc., Lawrence, MA (US)

( * ) Notice: Subject to any disclaimer, the term of this patent is extended or adjusted under 35 U.S.C. 154(b) by 0 days.

(21) Appl. No.: 10/932,498

(22) Filed: Sep. 2, 2004

(65) Prior Publication Data

US 2005/0061802 A1 Mar. 24, 2005

Related U.S. Application Data

(60) Provisional application No. 60/501,110, filed on Sep. 8, 2003.

(51) Int. Cl.
*H05B 3/54* (2006.01)

(52) U.S. Cl. ..... 219/529; 219/545; 219/549

(58) Field of Classification Search ..... 219/545, 219/529, 211–213, 549, 217, 527, 528; 29/91.1, 29/610.1, 611

See application file for complete search history.

(56) References Cited

U.S. PATENT DOCUMENTS

| | | | |
|---|---|---|---|
| 540,398 | A | 6/1895 | Meek |
| 729,171 | A | 5/1903 | Herrgott |
| 2,107,598 | A | 2/1938 | Colvin, Jr. |
| 2,381,218 | A | 8/1945 | Jacob |
| 2,385,577 | A | 9/1945 | Jacob |
| 2,432,785 | A | 12/1947 | Moberg |
| 2,670,620 | A | 3/1954 | Goldstraub |
| 2,862,097 | A | 11/1958 | Negromanti |
| 3,425,020 | A | 1/1969 | Toyooka et al. |
| 3,478,422 | A | 11/1969 | Inui |
| 3,513,297 | A | 5/1970 | Jordan |
| 3,721,799 | A | 3/1973 | Carlstrom |
| 4,020,653 | A | 5/1977 | Mishcon et al. |
| 4,063,069 | A | 12/1977 | Peeri |
| 4,538,054 | A | 8/1985 | de la Bretoniere |
| 4,713,531 | A | 12/1987 | Fennekels et al. |
| 4,838,045 | A | 6/1989 | Cournoyer et al. |
| 4,983,814 | A | 1/1991 | Ohgushi et al. |
| 4,986,090 | A | 1/1991 | Lombardi |
| 5,484,983 | A | 1/1996 | Roell |
| 6,160,246 | A | 12/2000 | Rock et al. |
| 6,215,111 | B1 | 4/2001 | Rock et al. |
| 6,307,189 | B1 | 10/2001 | Rock et al. |
| 6,373,034 | B1 | 4/2002 | Rock et al. |
| 6,414,286 | B1 | 7/2002 | Rock et al. |
| 6,501,055 | B1 | 12/2002 | Rock et al. |

FOREIGN PATENT DOCUMENTS

EP 1 201 806 5/2002

OTHER PUBLICATIONS

European Search Report; EP 04 25 5436; Nov. 10, 2004; DeLa Tassa Laforgue.

*Primary Examiner*—Robin O. Evans
*Assistant Examiner*—Vinod Patel
(74) *Attorney, Agent, or Firm*—Fish & Richardson P.C.

(57) ABSTRACT

A fabric article that generates heat upon application of electrical power is formed, for example, by knitting or weaving, to form a fabric prebody. An electrical resistance heating element in the form of a conductive yarn is incorporated into the fabric prebody, e.g., laid in, e.g., in the knit-welt or tuck-welt configuration, the electrical resistance heating elements extending between opposite edge regions of the fabric. Conductive elements are provided for connecting the electrical resistance heating elements to a source of electrical power.

82 Claims, 9 Drawing Sheets

ELECTRIC HEATING/WARMING FABRIC ARTICLES

This application claims benefit from U.S. Provisional Patent Application 60/501,110, filed Sep. 8, 2003.

TECHNICAL FIELD

This invention relates to fabric articles, which generate heat/warmth upon application of electricity.

BACKGROUND

Fabric heating/warming articles are known, e.g., in the form of electric blankets, heating and warming pads and mats, heated garments, and the like. Typically, these heating/warming articles consist of a fabric body defining one or a series of envelopes or tubular passageways into which electrical resistance heating wires or elements have been inserted. In some instances, the electric resistance heating wires are integrally incorporated into the fabric body during its formation, e.g., by weaving or knitting. Relatively flexible electric resistance heating wires or elements, e.g., in the form of a core of insulating material, e.g., yarn, about which is disposed an electrical conductive element, e.g., a helically wrapped metal wire or an extruded sheath of one or more layers of conductive plastic, have been incorporated directly into the woven or knitted structure of a fabric body.

SUMMARY

According to one aspect of the invention, a method of forming a fabric article adapted to generate heat upon application of electrical power comprises the steps of: joining, in a continuous web, by a reverse plaiting circular knitting process, a stitch yarn and a loop yarn to form a fabric prebody, the stitch yarn forming a technical face of the fabric prebody and the loop yarn forming a technical back of the fabric prebody, the loop yarn forming in loops that overlay the stitch yarn at the technical face and the technical back of the fabric prebody, at spaced-apart intervals, incorporating into the fabric prebody an electrical resistance heating element laid in, in knit-welt configuration, forming the fabric prebody into a fabric body, with the electrical resistance heating elements extending between opposite edge regions of the fabric body, and providing conductive elements for connecting the electrical resistance heating elements to a source of electrical power. In some embodiments, the electrical resistance heating element is laid in, in tuck-welt configuration, rather than knit-welt.

Preferred embodiments of the invention can include one or more the following additional steps: finishing at least one of the technical face and the technical back of the fabric body, in a manner avoiding damage to electrical conductivity of the electrical resistance heating elements, to form a fleece surface region, or finishing the technical face of the fabric body, in a manner to avoid damage to electrical conductivity of the electrical resistance heating elements, to form a first fleece surface region, and finishing the technical back of the fabric body in a manner to avoid damage to electrical conductivity of the electrical resistance heating elements to form a second fleece surface region; applying, directly to the continuous web, the conductive elements for connecting the electrical resistance heating elements to a source of electrical power; incorporating into the fabric body the electrical resistance heating element, typically in the form of a conductive yarn comprising a core of insulating material and an electrical resistance heating filament disposed generally about the core; in some embodiments, the conductive yarn further comprises a sheath material generally surrounding the electrical resistance heating filament and the core, e.g., sheath material formed by wrapping the electrical resistance heating filament and the core with yarn; incorporating into the fabric prebody the electrical resistance heating element in the form of a conductive yarn comprising an electrical resistance heating filament; connecting the conductive element to a source of electric power and generating heat, the source of electric power comprising alternating current or direct current, e.g., in the form of a battery, which can be mounted to the fabric article; limiting formation of loops to a central region of the fabric prebody, the central region being spaced from edge regions in the fabric body, and providing the conductive elements for connecting the electrical resistance heating elements to a source of electrical power in the edge regions of the fabric body; and/or rendering the yarns of the fabric body hydrophilic or hydrophobic.

According to another aspect of the invention, a fabric article adapted to generate heat upon application of electrical power comprises a fabric body, a plurality of spaced apart electrical resistance heating elements incorporated into the fabric body in the knit-welt lay in configuration and extending generally between opposite edge regions of the fabric body, and electrical conductor elements extending generally along the opposite edge regions of the fabric body and adapted to connect the plurality of spaced apart electrical resistance heating elements to a source of electrical power. Alternatively, the electrical resistance heating elements can be incorporated into the fabric body in the tuck-welt lay in configuration.

Preferred embodiments of this aspect of the invention can include one or more the following additional features. The electrical conductor elements are adapted for connecting the plurality of spaced-apart electrical resistance heating elements to a power source of alternating current or to a power source of direct current, e.g., a battery, which can be mounted to the fabric body. A series of at least three of the plurality of electrical resistance heating elements are symmetrically spaced and/or a series of at least three of the plurality of electrical resistance heating elements are asymmetrically spaced. The fabric body comprises a knitted body, e.g., a reverse plaited circular knitted, or other circular knitted (such as double knitted, single jersey knitted, two-end fleece knitted, three-end fleece knitted, terry knitted or double loop knitted), warp knitted or weft knitted body, or a woven body. The fabric body comprises hydrophilic or hydrophobic material. The fabric body has a technical face formed by a stitch yarn and a technical back formed by a loop yarn. The loop yarn forms loops that overlay the stitch yarn at the technical face and the technical back of the fabric prebody. The fabric prebody has loops formed only in a center region. The fabric body has fleece formed upon at least one, and preferably both, of the technical back and the technical face. The conductive yarn is tied in, e.g., by tuck or welt. The electrical conductor elements, at least in part, are applied as an electrically conductive paste or as an electrically conductive hot melt adhesive. The electrical conductor elements can comprise a conductive wire. The conductive yarn can comprise a core of insulating material, an electrical resistance heating filament disposed generally about the core, and a sheath material generally surrounding the electrical resistance heating filament and the core. Typically, the core comprises a yarn of synthetic material, e.g., polyester or nylon; the sheath material comprises yarn, e.g., of a synthetic material, such as polyester or nylon, wrapped about the electrical resistance heating filament and the core; and the electrical resistance heating filament comprises at least one metal filament, typically at least three metal filaments, wrapped helically about the core, the metal filament of the electrical resistance heating filament being formed of stainless steel. The electrical resistance heating element has electrical resistance in the range of about 0.1 ohm/cm to about 500 ohm/cm. In some embodiments, the electrical resistance heating element has electrical resistance of about 190 ohm/m (1.9 ohm/cm), or 250 ohm/m (2.5 ohm/cm). In other embodiments of the conductive yarn, the core and/or the sheath material can be omitted.

An objective of the invention is to provide electric heating/warming fabric articles, e.g., electric blankets, heating and warming pads, heated garments, etc., into which a plurality of spaced-apart electric resistance heating members, in the form of conductive yarns, are incorporated by a knitting or weaving process. The fabric body of the heating/warming article, including the incorporated electric resistance heating members, can subsequently be subjected to a fabric finishing process, e.g., one or both surfaces of the fabric body can be napped, brushed, sanded, etc., to form fleece. In a planar structure, such as an electric heating blanket, the electric resistance heating members are connected at their ends along opposite edge regions of the planar fabric body, i.e., of the blanket, and can be powered by alternating current or direct current, including by one or more batteries mounted to the blanket.

The present invention has a number of advantages. For example, the length of the electric resistance heating element required to make the fabrics described herein (e.g., tied in in the tuck-welt or knit-welt position) is substantially less than is required for fabrics which incorporate an electric resistance heating element as a stitch yarn (e.g., 100% knit in), reducing the cost significantly, e.g., in one particular example, the length of the electrical resistance element is reduced by about 30%. Furthermore, as the electric resistance heating element is not required to go through the full stitch formation, coarser (i.e., relatively thicker) heating elements can be used, which are generally less costly, less flexible and less pliable, and have a higher resistance (ohm/meter), than do the finer wires typically preferred for electric resistance heating elements incorporated as stitch yarn. The use of the knit-welt configuration results in the electric resistance heating element being held securely in place, minimizing the likelihood of damage during the napping process.

The details of one or more embodiments of the invention are set forth in the accompanying drawings and the description below. Other features, objects, and advantages of the invention will be apparent from the description and drawings, and from the claims.

DESCRIPTION OF DRAWINGS

FIG. 12 is a somewhat diagrammatic end section view of a preferred embodiment of a conductive yarn for an electric heating/warming fabric article of the invention, while

In FIG. 24A, only the stitch yarn and one electric resistance heating element are depicted; the loop yarn is omitted for clarity.

In FIG. 25A, only the stitch yarn and one electric resistance heating element are depicted; the loop yarn is omitted for clarity.

DETAILED DESCRIPTION

Figure 1:
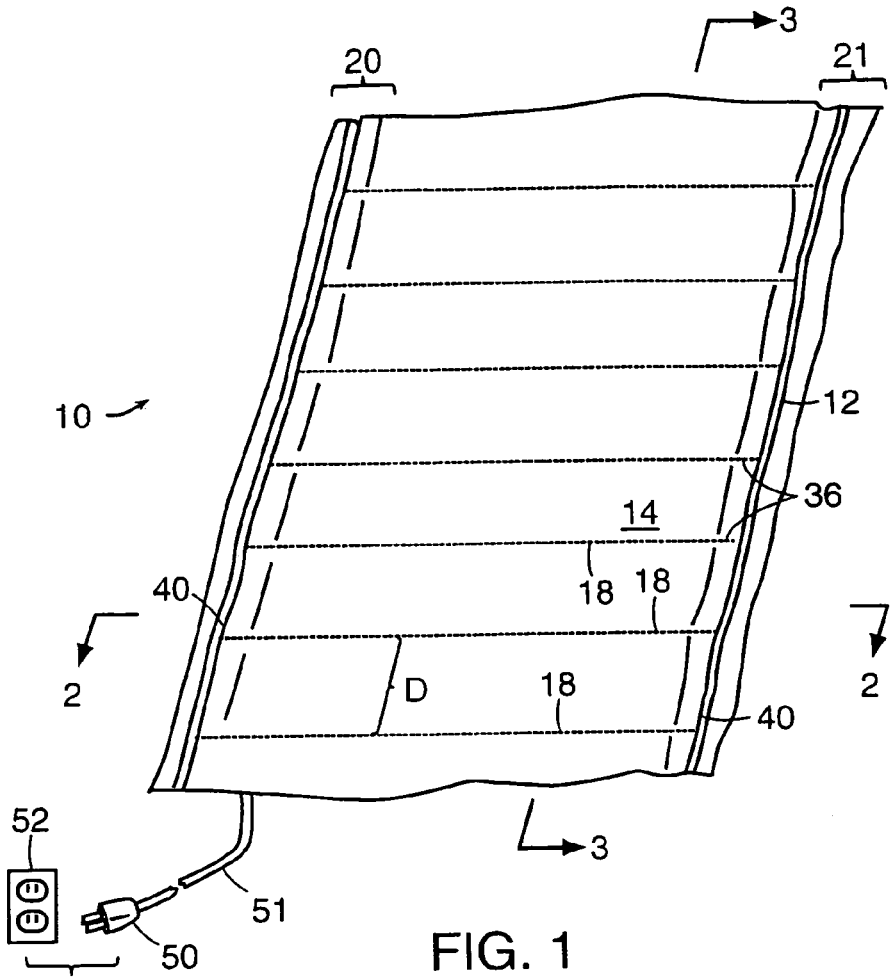
FIG. 1 is a perspective view of an electric heating/warming composite fabric article of the invention in the form of an electric blanket.

Referring to FIG. 1, an electric heating/warming composite fabric article of the invention, e.g., an electric blanket 10, adapted to generate heat upon application of electrical power, consists of a fabric body 12 having a technical back 14 and a technical face 16. The fabric body 12 incorporates a plurality of spaced-apart electric resistance heating elements 18 extending between opposite edge regions 20, 21 of the fabric body.

Figure 2:
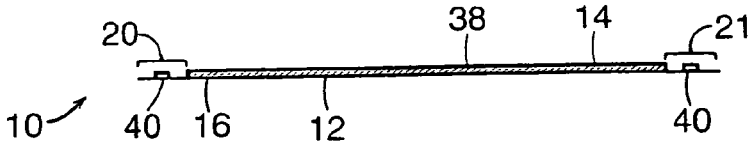
FIG. 2 is an end section view of the electric heating/warming composite fabric article of FIG. 1, taken at the line 2—2.
Figure 3:
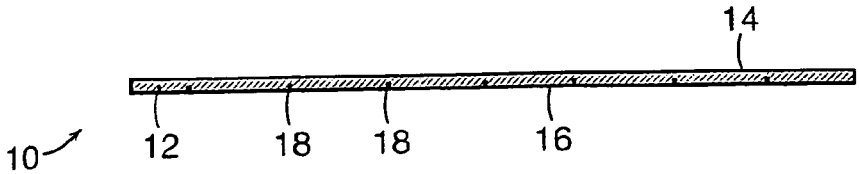
FIG. 3 is a side section view of the electric heating/warming composite fabric article of FIG. 1, taken at the line 3—3.
Figure 4:
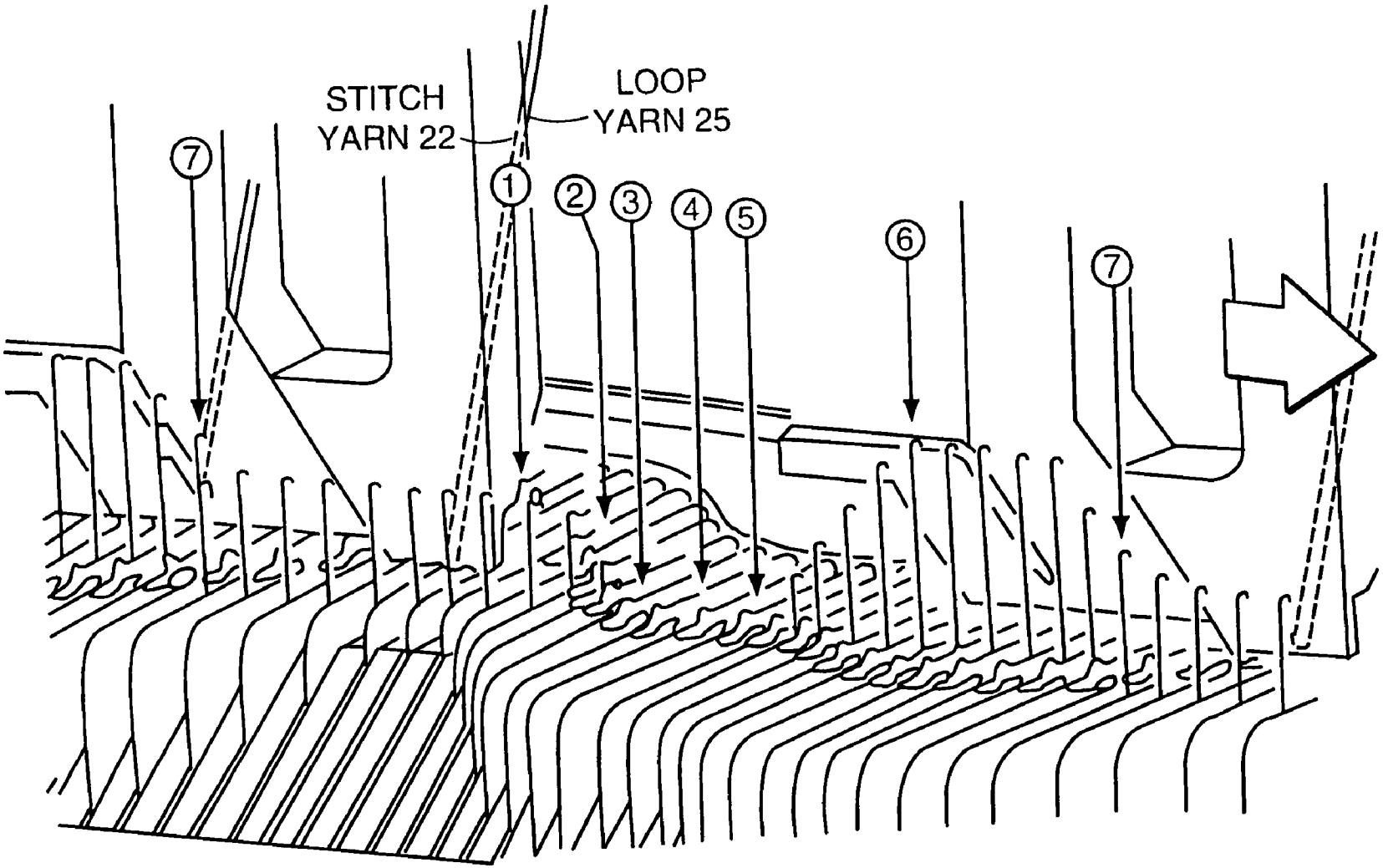
FIG. 4 is a perspective view of a segment of a circular knitting machine.
Figure 5:
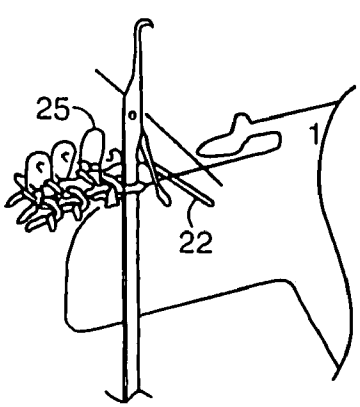
FIGS. 5–11 are sequential views of a cylinder latch needle in a reverse plaiting circular knitting process, e.g., for use in forming an electric heating/warming composite fabric article of the invention.
Figure 6:
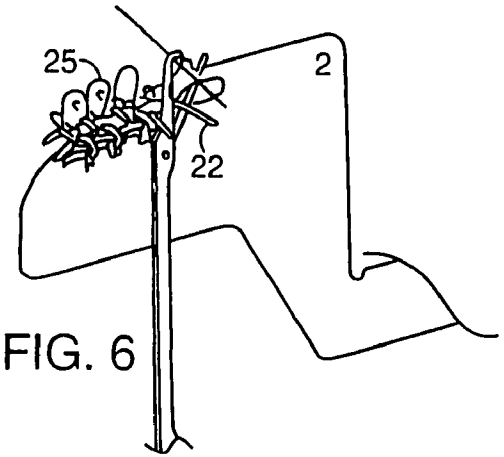
Figure 7:
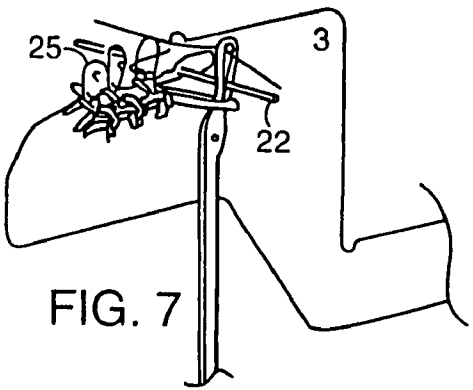
Figure 8:
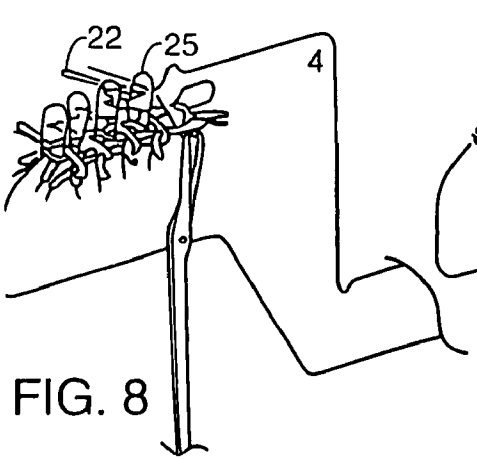
Figure 9:
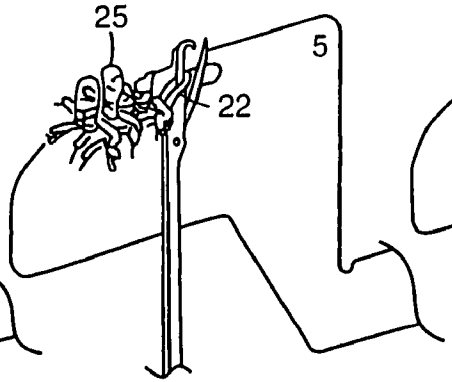
Figure 10:
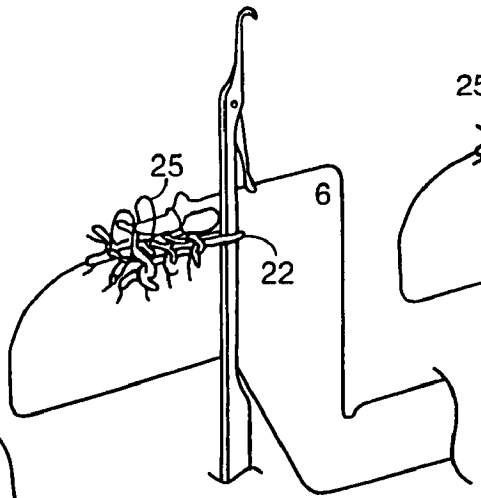
Figure 11:
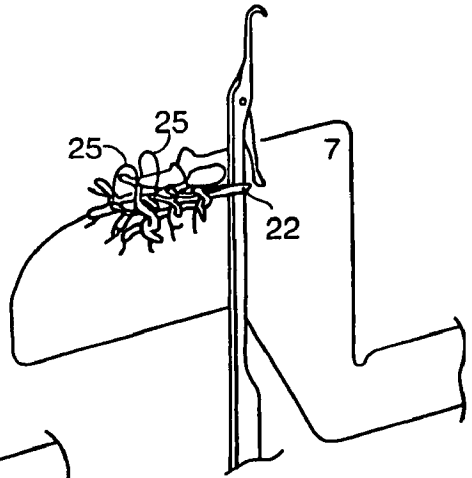
Figure 13:
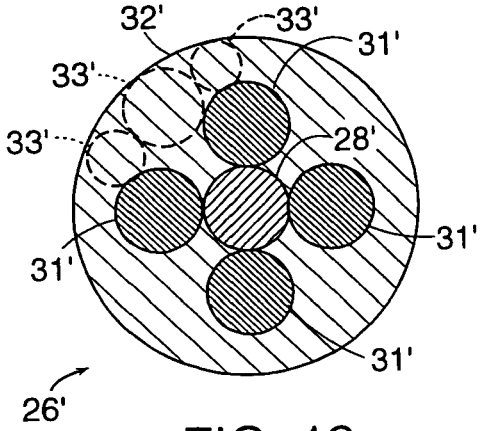
FIGS. 13–16 and 16A are similar views of alternative embodiments of conductive yarns for electric heating/warming fabric articles of the invention.

Referring also to FIGS. 4–11, in a preferred embodiment, the fabric body 12 is formed (in a continuous web) by joining a stitch yarn 22 and a loop yarn 25 in a standard reverse plaiting circular knitting (terry knitting) process, e.g., as described in Knitting Technology, by David J. Spencer (Woodhead Publishing Limited, 2nd edition, 1996), the entire disclosure of which is incorporated herein by reference. Referring again to FIGS. 2 and 3, in the terry knitting process, the stitch yarn 22 forms the technical face 16 of the resulting fabric body and the loop yarn 25 forms the opposite technical back 14, where it is formed into loops (25, FIG. 10) extending over the stitch yarn 22. In the fabric body 12 formed by reverse plaiting circular knitting, the loop yarn 25 extends outwardly from the planes of both surfaces and, on the technical face 16, the loop yarn 25 covers the stitch yarn 22 (e.g., see FIG. 17). As a result, during napping of the opposite fabric surfaces to form a fleece, the loop yarn 25 and stitch yarn 22 protect the conductive yarns 26 knitted into the fabric body as a laid in yarn.

The loop yarn 25 forming the technical back 14 of the knit fabric body 12 can be made of any synthetic or natural material. The cross section and luster of the fibers or the filament can be varied, e.g., as dictated by requirements of the intended end use. The loop yarn can be a spun yarn made by any available spinning technique, or a filament yarn made by extrusion. The loop yarn denier is typically between 40 denier to 300 denier. A preferred loop yarn is a 200/100 denier T-653 Type flat polyester filament, e.g., as available commercially from E.I. duPont de Nemours and Company, Inc., of Wilmington, Del.

The stitch yarn 22 forming the technical face 16 of the knit fabric body 12 can be also made of any type of synthetic or natural material in a spun yarn or a filament yarn. The denier is typically between 50 denier to 150 denier. A preferred yarn is a 70/34 denier filament textured polyester, e.g., as available commercially from UNIFI, Inc., of Greensboro, N.C.

Figure 12:
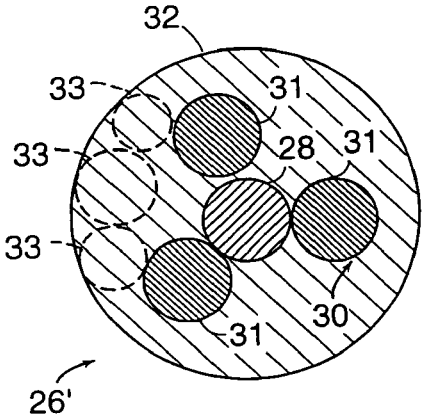

Referring now also to FIG. 12, and also to FIGS. 13–16, at spaced intervals during the knitting process, an electric resistance heating member 18 in the form of a conductive yarn 26 is incorporated into the fabric body 12 in place of the stitch yarn 22. Referring to FIG. 12, in a preferred embodiment, the conductive yarn 26 forming the electrical resistance heating elements 18 consists of a core 28 of insulating material, e.g., a polyester or nylon yarn, about which extends an electrical conductive element 30, e.g., three filaments 31 of stainless steel wire (e.g., 316L stainless steel) wrapped helically about the core 28, and an outer covering 32 of insulating material, e.g., polyester yarns 33 (only a few of which are suggested in the drawings) helically wrapped about the core 28 and the filaments 31 of the electrical conductive element 30. The conductive yarn 26 can be fabricated using standard methods, or can be obtained, e.g., from Bekaert Fibre Technologies, Bekaert Corporation, of Marietta, Ga.

Figure 16A:
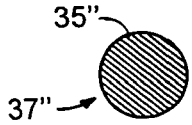
Figure 15:
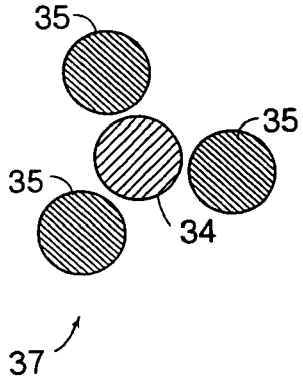
Figure 16:
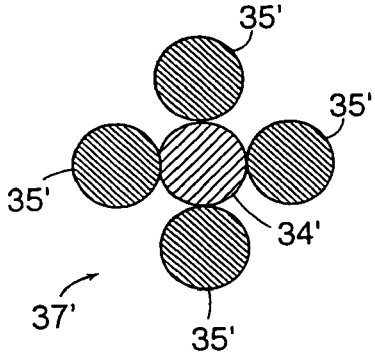
Figure 14:
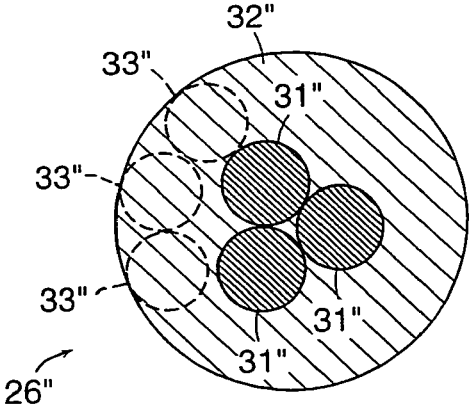

The number of conductive filaments in the conductive yarn, and where the filaments are located, are dependent, e.g., on the end use requirements. For example, in alternative configurations, in FIG. 13, conductive yarn 26' has four filaments 31' wrapped about core 28' with an outer covering 32' of polyester yarns 33'; in FIG. 14, conductive yarn 26" has three filaments 31" wrapped by outer covering 32" of polyester yarns 33", without a core. Referring to FIGS. 15 and 16, in other embodiments, conductive yarns 37, 37', respectively, are formed without an outer covering about the filaments 35, 35', respectively, wrapped about core 34, 34', respectively, the stitch yarn 22 and loop yarn 25 of the fabric body 12 instead serving to insulate the conductive yarns in the heating/warming fabric article. Referring to FIG. 16A, a conductive yarn 37" without an outer cover or sheath, formed, e.g., of one or more bare filaments (one filament 35" is shown) can also be formed without an insulating core, again, with yarn of the fabric body arranged to insulate the conductive yarns in the heating/warming fabric body. The resistance of the conductive yarn can be selected in the range, e.g., of from about 0.1 ohm/cm to about 500 ohm/cm on the basis of end use requirements of the heating/warming fabric article 10. However, conductive yarns performing outside this range can also be employed, where required. In some embodiments, the resistance of the conductive yarn is about 1.9 ohm/cm (190 ohm/m). In other embodiments, the resistance of the conductive yarn is about 2.5 ohm/cm (250 ohm/m). The core of the conductive yarn and the sheath material of the outer covering over the conductive filaments can be made of synthetic or natural material. In some embodiments, the core and/or sheath are made of polyester, e.g., about 600 denier polyester, or of nylon, e.g., about 140 denier nylon. The outer covering can also have the form of a sleeve, e.g., a dip-coated or extruded sleeve. Conductive yarns of different constructions suitable for use according to this invention can also be obtained from Bekaert Fibre Technologies.

In some embodiments, the conductive yarn comprises four wires, of about 35 micron diameter, wrapped around a core of 140 denier nylon, with a resistance of about 190 ohms/meter. In other embodiments, the conductive yarn comprises four wires, of about 35 micron diameter, wrapped around a core of 140 denier nylon, with a resistance of about 250 ohms/meter. In some embodiments, the conductive yarn comprises about 90 wires, each of about 14 microns in diameter, without a core, with a resistance of about 70 ohms/meter.

In the preferred method of the invention, the fabric body 12 is formed by reverse plaiting on a circular knitting machine. This is principally a terry knit, where the loops formed by the loop yarn 25 cover the stitch yarn 22 on the technical face 16 (see FIG. 17).

The conductive yarn is incorporated into the knit fabric prebody formed on the circular knitting machine at a specific spacing or distance apart, D (FIG. 1), for uniform heating in the resulting heating/warming fabric article 10. In a fabric prebody of the invention, the spacing is typically a function, e.g., of the requirements of heating, energy consumption and heat distribution in the article to be formed. For example, the spacing of conductive yarns can be in the range of from about 0.02 inch to about 2.5 inches. However, other spacing can be employed, depending on the conditions of intended or expected use, including the resistance of the conductive yarns. The conductive yarns can be spaced symmetrically from each other, or the conductive yarns can be spaced asymmetrically, with varying spacing, as desired. Also, in a fabric body of the invention, the power consumption for each conductive yarn is generally considerably lower than in the separate heating wires of prior art devices. As a result, the conductive yarns in a fabric body of the invention can be more closely spaced, with less susceptibility to hot spots.

The preferred position of the conductive yarn is laid in, e.g., in knit-welt or tuck-welt configuration. The knit (knit-welt) or tuck (tuck-welt) stitch holds the laid in conductive yarn. The conductive yarn can be knit symmetrically, i.e., at a specific distance apart, in each repeat, i.e., the conductive yarn can be laid in at any feed repeat of the circular knitting machine. Alternatively, the conductive yarns can be knit asymmetrically, with the yarns more closely or widely spaced, e.g., as desired or as appropriate to the intended product use. Again, the specific number of feeds, and the spacing of the conductive yarns, is dependent on the end use requirements. In addition, the configuration can be, e.g., knit-welt 1×1, 1×2, 1×3, 1×4, 1×5, 2×2, 2×3, 2×4, 2×5, or any other suitable configuration, again, depending on the end use requirements. As compared to tuck-welt lay-in, in the knit-welt lay in configuration the knit holds the laid in conductive yarn and keeps it from shifting or sticking out, minimizing the likelihood of damage to the conductive yarn during napping, even in knit construction with inherent stretch properties.

Figure 24A:
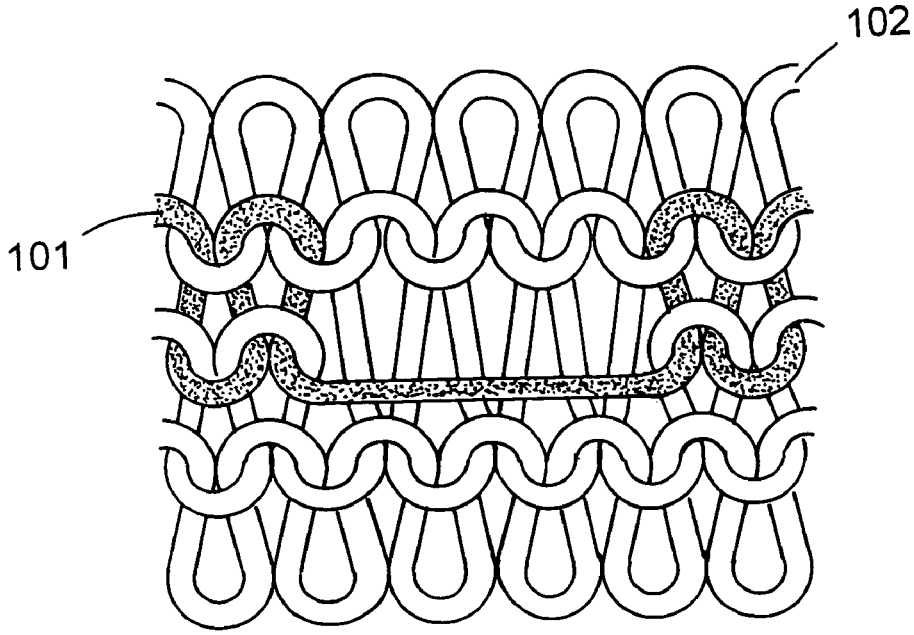
FIGS. 24A and B are somewhat diagrammatic representations of one embodiment of the invention, in which the knit-welt configuration is used.
Figure 24B:
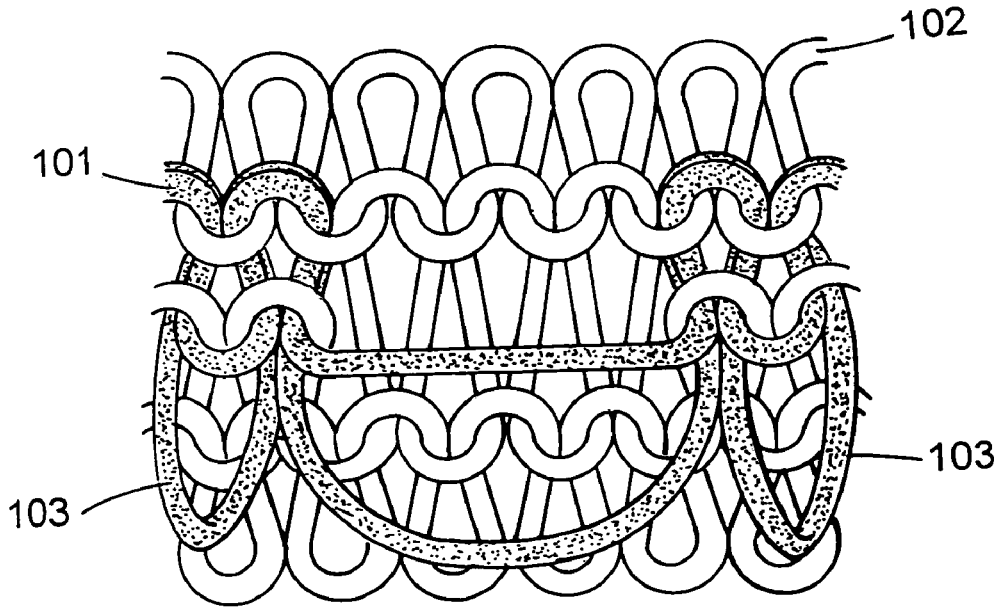
FIG. 24B includes the loop yarn, which lays over the conductive element.

FIGS. 24A and 24B illustrates knit-welt lay in configuration, with stitch yarn 102 (white yarn) and electric resistance heating element yarn 101 (stippled yarn); the loop yarn 103, which is shown in FIG. 24B, would be present in the preferred method of reverse plaiting circular knitting. The loop yarn is omitted from FIG. 24A for simplicity. FIGS. 24A and B illustrate a 2×3 knit-welt configuration.

Figure 25A:
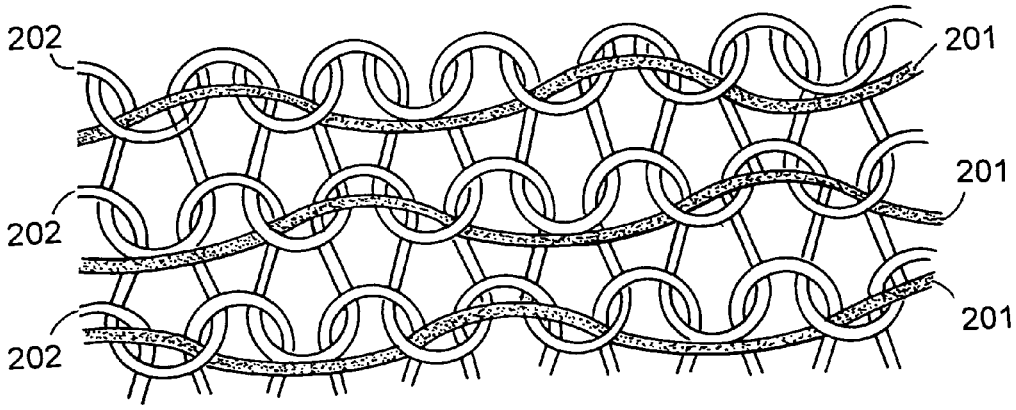
FIGS. 25A and B are somewhat diagrammatic representations of one embodiment of the invention, in which the tuck-welt configuration is used.
Figure 25B:
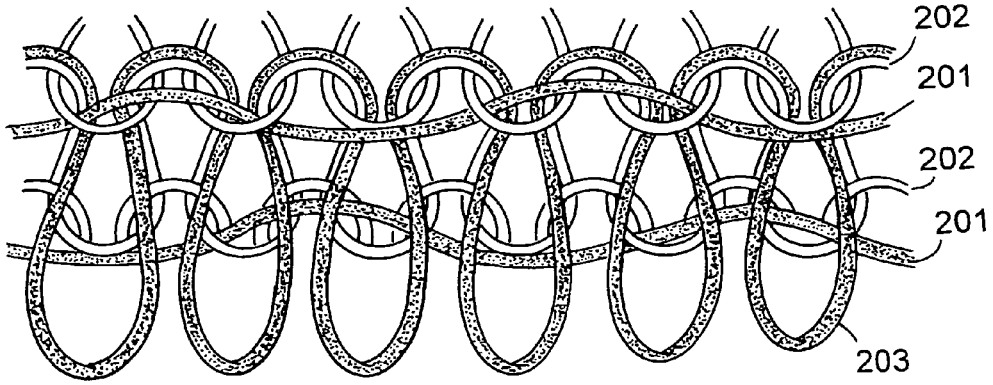
FIG. 25B includes the loop yarn.

FIGS. 25A and 25B illustrate the tuck-welt lay-in configuration. In some embodiments, the tuck-welt lay-in configuration can be used in stabilized knit construction. Referring to FIGS. 25A, and 25B, electric resistance heating element yarn 201 (stippled yarn) is laid in to the stitch yarn 202 (white yarn) in the tuck-welt position. Loop yarn 203 (stippled yarn), which would be present in the preferred method of reverse plaiting circular knitting, is shown in FIG. 25B, and omitted from FIG. 25A for simplicity. FIGS. 25A and B illustrate a 1×2 tuck-welt configuration.

Figure 17:
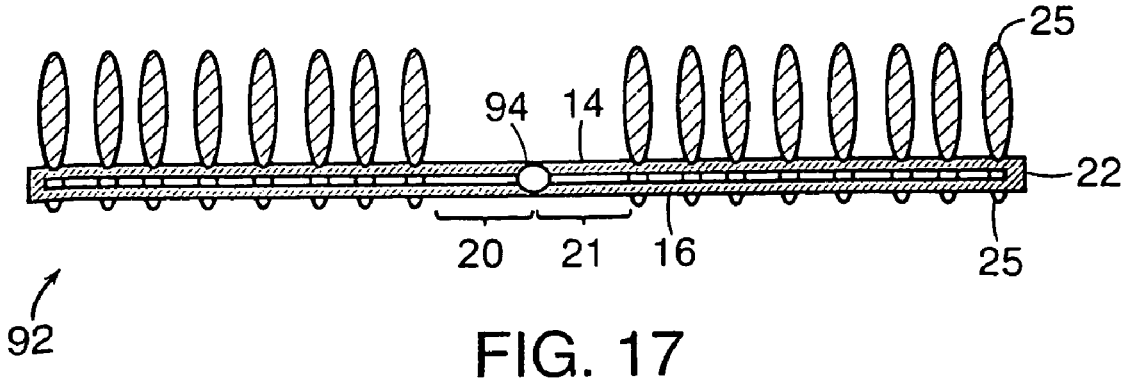
FIG. 17 is a somewhat diagrammatic section view of a segment of a tubular knit fabric during knitting.
Figure 18:
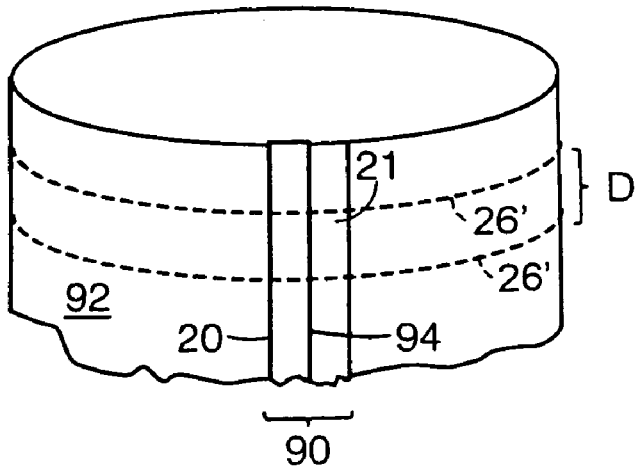
FIG. 18 is a somewhat diagrammatic perspective view of the tubular knit fabric of FIG. 17.

Referring to FIGS. 17 and 18, the end regions 20, 21 can be formed as a panel 90 in the tubular knit body 92. The edge regions 20, 21 of the fabric body are preferably formed without loops, and in a manner such that the edge regions do not curl upon themselves, e.g., the edge region panel is formed by single lacoste or double lacoste knitting. The ends portions 36 (FIG. 1) of the conductive yarns 26 extending into the flat regions 20, 21 without loops are thus more easily accessible in the end regions for completing an electrical heating circuit, as described below.

The tubular knit body 92 is removed from the knitting machine and slit, e.g., along a line of stitches 94 marking the desired slit line, to create a planar fabric. Alternatively, for increased accuracy, the tubular knit body 92 can be slit on line, e.g., by a cutting edge mounted to the knitting machine.

As described above, in the fabric article 10 of the invention, spaced apart conductive yarns 18 are electrically interconnected in parallel by conductor elements 40, e.g., in a blanket, extending along the edge regions. However, during the knitting process of formation, a continuous length of conductive yarn 26' (FIG. 18) can be inserted continuously during knitting, with the continuous length of conductive yarn only thereafter being segmented, e.g., by slitting the tubular knit body 92 (FIG. 18), into separate, spaced apart conductive yarns 26 to form the fabric article of the invention.

Figure 19A:
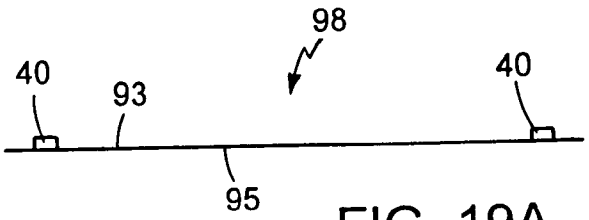
FIG. 19A is similar view of an electric heating/warming fabric article of the invention, e.g., a sheet or the like, without fleece on either face.

Preferably, the knitted fabric body 12 incorporating the electric resistance heating elements 18 in the form of the conductive yarns is next subjected to finishing. During the finishing process, the fabric body 12 can go through processes of sanding, brushing, napping, etc., to generate a fleece 38. The fleece 38 can be formed on one face of the fabric body 10 (FIG. 2), e.g., on the technical back 14, in the loop yarn, or a fleece 38, 38' can be formed on both faces of the fabric body 10' (FIG. 19), including on the technical face 16, in the overlaying loops of the loop yarn and/or in the stitch yarn. In either case, the process of generating the fleece on the face or faces of the fabric body is preferably performed in a manner to avoid damage to the conductive yarn which is part of the construction of the fabric body 12. Alternatively, referring to FIG. 19A, e.g., for the purpose of providing a fabric article in the form of a sheet 98 or the like, rather than in the form of a blanket, neither of surfaces 93, 95 can be subjected to finishing.

The fabric body can also be treated, e.g., chemically, to render the material hydrophobic or hydrophilic.

Figure 19:
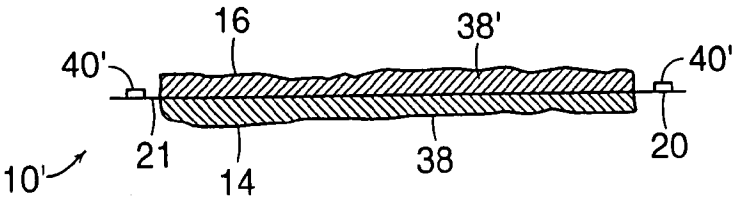
FIG. 19 is an end section view, similar to FIG. 2, of an electric heating/warming fabric article of the invention with fleece on both faces.
Figure 20:
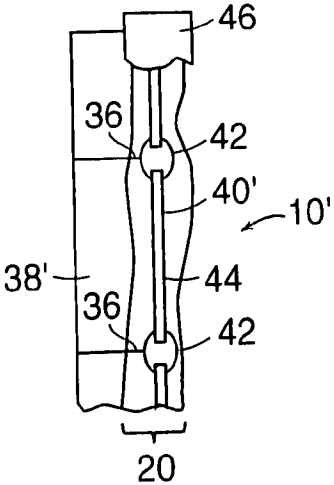
FIG. 20 is an enlarged, plan view of the technical face showing an alternative embodiment of a conductor element.

After finishing, and after the fabric body is heat set for width, the electric resistance heating elements are connected to a source of electrical power by conductors 40 in opposite edge regions 20, 21 (where, preferably, there are no loops on the surface), thereby to complete the electrical circuit. (The conductors or buses 40 can be formed on the technical back 14, as shown in FIG. 1, or they can instead be formed on the technical face 16, as seen in FIGS. 19 and 20.) Any suitable methods can be used to complete the circuit. For example, referring to FIG. 1, the conductor 40 can, at least in part, be applied in the form of a conductive paste, e.g., such as available commercially from Loctite Corporation, of Rocky Hill, Conn., or in the form of a conductive hot melt adhesive, conductive tape (with fabric or plastic base/carrier, or the like. The conductive paste or adhesive can be applied as a stripe to a surface of the fabric body 10 in electrical conductive relationship with the electrical resistance heating elements 18, and then connected to the power source. (If necessary, the conductive yarns can be exposed, e.g., the polyester or nylon covering yarn can be removed with solvent or localized heat, e.g., by laser; the covering yarn can be manually unraveled; or the fabric body 10 can be formed with a needle out in the flat regions 20, 21, thus to facilitate accessibility to each of the conductive yarns.) Alternatively, referring to FIG. 20, the conductor 40' can consist of localized dots or regions 42 of conductive paste applied in electrical contact with exposed portions of the electric resistance heating elements 18, with a conductive metal wire 44 disposed in electrical conductive contact with, and extending, preferably continuously, between, the localized conductive paste regions 42. The electric conductor 40' is thereafter covered by a cloth trim or edging material 46, attached, e.g., by stitching along the edge of the fabric body 10'.

Figure 21:
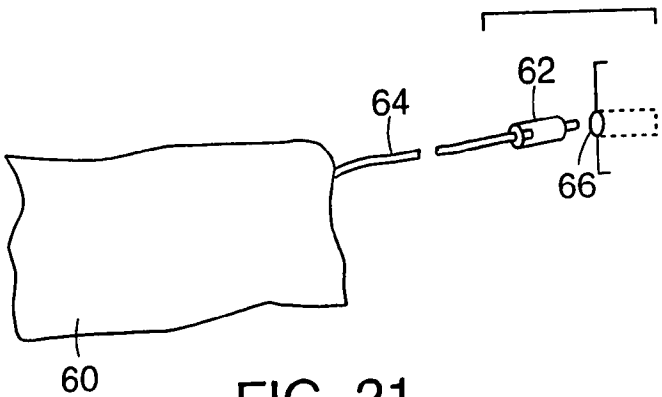
FIGS. 21, 22 and 23 are somewhat diagrammatic representations of other embodiments of heating/warming fabric articles of the invention, as adapted to be powered by direct current, e.g., an automobile warming or heating pad (FIG. 21), adapted to be powered from an automobile battery; and a stadium or camping blanket (FIG. 22) and a garment (FIG. 23), adapted to be powered from a battery replaceably mounted to the article.
Figure 22:
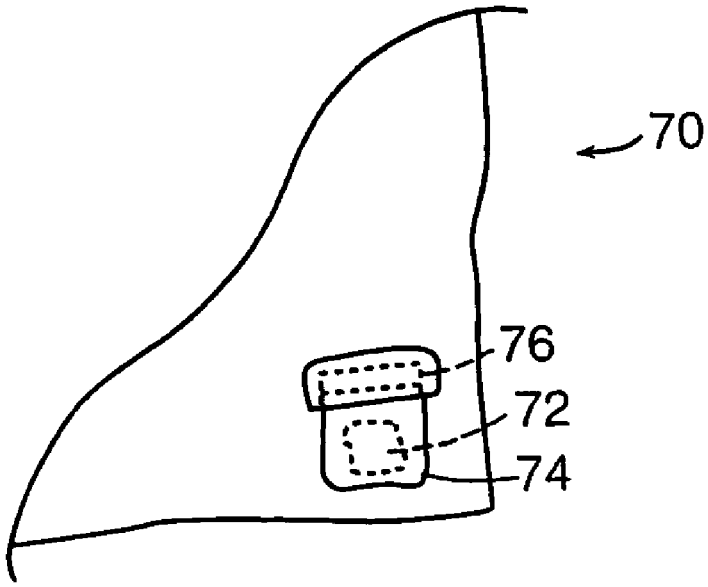
Figure 23:
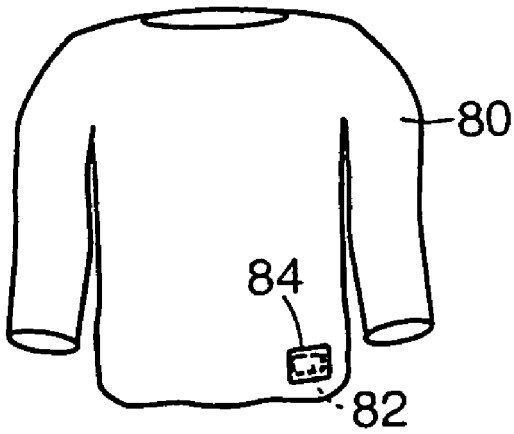

The completed circuit is next connected to a power source to supply electrical power to the electrical resistance heating elements for the required amount of heat generation. For example, referring to FIG. 1, an electric heating/warming fabric article 10 of the invention (an electric blanket) is adapted for connection to a source of alternating current by means of plug 50 on cord 51 for insertion in household outlet 52. Referring to FIG. 21, a warming or heating pad 60 of the invention, e.g., for an automobile seat, is adapted for connection to a source of direct current by means of plug 62 on cord 64 for insertion into the cigarette lighter or other power outlet 66 of an automobile. Referring to FIGS. 22 and 23, a stadium or camping blanket 70 and a garment 80 of the invention each includes a source of direct current, i.e. a battery pack 72, 82, respectively, e.g., as available from Polaroid Corporation, of Cambridge, Mass., replaceably mounted to the heating/warming fabric article, e.g., in a pocket 74, 84, respectively. Referring to FIG. 22, the pocket can be secured by a hook-and-loop type fastener 76. Preferably, for certification by Underwriters' Laboratory (UL7), the voltage supplied by the power source to the electrical resistance heating elements is lower than 25 volts, e.g., a Class II UL7 certified transformer can be used to step down a 110 volt power supply to 25 volts or under.

Also, for improved efficiency during manufacturing, busses or conductors 40 can be applied to the fabric body 12 before it is subjected to finishing. For example, the conductor 40 applied as a continuous strip of conductive paste or adhesive can be applied directly to the continuous web, either continuously, or in a predetermined intermittent pattern, e.g., using a print wheel or the like. The fabric body 12, with the conductors 40 formed thereupon, can thereafter be subjected to finishing and other steps of manufacturing.

OTHER EMBODIMENTS

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims. For example, any type of yarn can be employed.

What is claimed is:

1. A method of forming a fabric article adapted to generate heat upon application of electrical power, said method comprising:

joining, in a continuous web, by a reverse plaiting circular knitting process, a stitch yarn and a loop yarn to form a fabric prebody, the stitch yarn forming a technical face of the fabric prebody and the loop yarn forming a technical back of the fabric prebody, the loop yarn forming in loops that overlay the stitch yarn at the technical face and at the technical back of the fabric prebody;

at spaced-apart intervals, incorporating into the fabric prebody an electrical resistance heating element, laid in in the welt position;

forming the fabric prebody into a fabric body, with the electrical resistance heating elements extending between opposite edge regions of the fabric body; and providing conductive elements for connecting the electrical resistance heating elements to a source of electrical power.

2. The method of claim 1, wherein the laid in electrical resistance heating element is in tuck-welt configuration.

3. The method of claim 1, wherein the laid in electrical resistance heating element is in knit-welt configuration.

4. The method of claim 2 or 3, comprising the further step of finishing at least one of said technical face and said technical back of the fabric body, in a manner avoiding damage to electrical conductivity of the electrical resistance heating elements, to form a fleece surface region.

5. The method of claim 2 or 3, comprising the further steps of finishing the technical face of the fabric body, in a manner to avoid damage to electrical conductivity of the electrical resistance heating elements, to form a first fleece surface region, and finishing the technical back of the fabric body in a manner to avoid damage to electrical conductivity of the electrical resistance heating elements to form a second fleece surface region.

6. The method of claim 2 or 3, comprising the further step of applying, directly to the continuous web, the conductive elements for connecting the electrical resistance heating elements to a source of electrical power.

7. The method of claim 2 or 3, comprising the further step of incorporating into fabric prebody the electrical resistance heating element in the form of a conductive yarn comprising a core of insulating material and an electrical resistance heating filament disposed generally about said core.

8. The method of claim 6, wherein the conductive yarn further comprises a sheath material generally surrounding said electrical resistance heating filament and said core.

9. The method of claim 7, comprising the further step of forming the sheath material by wrapping said electrical resistance heating filament and said core with yarn.

10. The method of claim 2 or 3, comprising the further step of incorporating into the fabric prebody the electrical resistance heating element in the form of a conductive yarn comprising an electrical resistance heating filament.

11. The method of claim 2 or 3 comprising the further step of connecting the conductive element to a source of electric power and generating heat.

12. The method of claim 10 comprising the further step of connecting the conductive element to a source of electric power comprising alternating current and generating heat.

13. The method of claim 10 comprising the further step of connecting the conductive element to a source of electric power comprising direct current and generating heat.

14. The method of claim 12 comprising the further step of connecting the conductive element to a source of electric power comprising direct current in the form of a battery and generating heat.

15. The method of claim 13 comprising the further step of connecting the conductive element to a source of electric power comprising direct current in the form of a battery mounted to the fabric article and generating heat.

16. The method of claim 2 or 3, further comprising:

limiting formation of loops to a central region of the fabric prebody, the central region being spaced from edge regions in the fabric body; and providing the conductive elements for connecting the electrical resistance heating elements to a source of electrical power in the edge regions of the fabric body.

17. The method of claim 2 or 3 comprising the further step of rendering the yarns of said fabric body hydrophilic.

18. The method of claim 1 comprising the further step of rendering the yarns of said fabric body hydrophobic.

19. A fabric article adapted to generate heat upon application of electrical power, comprising:

a fabric body;

a plurality of spaced apart electrical resistance heating elements incorporated into said fabric body, laid in, in the welt position, and extending generally between opposite edge regions of said fabric body; and electrical conductor elements extending generally along said opposite edge regions of said fabric body and adapted to connect said plurality of spaced apart electrical resistance heating elements to a source of electrical power.

20. The fabric article of claim 19, wherein said laid in electrical conductor elements are in tuck-welt configuration.

21. The fabric article of claim 19, wherein said laid in electrical conductor elements are in knit-welt configuration.

22. The fabric article of claim 20 or 21, wherein said electrical conductor elements are adapted for connecting said plurality of spaced-apart electrical resistance heating elements to a power source of alternating current.

23. The fabric article of claim 20 or 21, wherein said electrical conductor elements are adapted for connecting said plurality of spaced-apart electrical resistance heating elements to a power source of direct current.

24. The fabric article of claim 23, wherein said power source of direct current comprises a battery.

25. The fabric article of claim 24, wherein said battery is mounted to said fabric body.

26. The fabric article of claim 20 or 21, wherein said fabric article further comprises a power source connected to said plurality of spaced apart electrical resistance heating elements by said electrical conductor elements, said power source comprising a battery mounted to said fabric body.

27. The fabric article of claim 20 or 21, wherein a series of at least three electrical resistance heating elements of said plurality of electrical resistance heating elements are symmetrically spaced.

28. The fabric article of claim 27, wherein a series of at least three electrical resistance heating elements of said plurality of electrical resistance heating elements are asymmetrically spaced.

29. The fabric article of claim 20 or 21, wherein a series of at least three electrical resistance heating elements of said plurality of electrical resistance heating elements are asymmetrically spaced.

30. The fabric article of claim 20 or 21, wherein said fabric body comprises a knitted body.

31. The fabric article of claim 30, wherein said fabric body comprises a reverse plaited circular knitted body.

32. The fabric article of claim 20 or 21, wherein said fabric body comprises a woven body.

33. The fabric article of claim 20 or 21, wherein said fabric body comprises hydrophilic material.

34. The fabric article of claim 20 or 21, wherein said fabric body comprises hydrophobic material.

35. The fabric article of claim 20 or 21, wherein said fabric body has a technical face formed by a stitch yarn and a technical back formed by a loop yarn.

36. The fabric article of claim 35, wherein said loop yarn forms loops that overlay the stitch yarn at the technical face and the technical back of the fabric body.

37. The fabric article of claim 35, wherein said fabric body has loops formed only in a center region.

38. The fabric article of claim 35, wherein said fabric body has a fleece formed upon at least one of said technical back and said technical face.

39. The fabric article of claim 38, wherein said fabric body has a fleece formed upon both of said technical back and said technical face.

40. The fabric article of claim 20 or 21, wherein said electrical conductor elements, at least in part, are applied as a conductive paste.

41. The fabric article of claim 40, wherein said electrical conductor elements comprise a conductive wire.

42. The fabric article of claim 20 or 21, wherein said electrical conductor elements, at least in part, are applied as a conductive hot melt adhesive.

43. The fabric article of claim 20 or 21, wherein said electrical resistance heating element has the form of a conductive yarn comprising a core of insulating material, an electrical resistance heating filament disposed generally about said core, and a sheath material generally surrounding said electrical resistance heating filament and said core.

44. The fabric article of claim 43, wherein said core comprises a yarn of synthetic material.

45. The fabric article of claim 44, wherein said synthetic material is polyester.

46. The fabric article of claim 44, wherein said synthetic material is nylon.

47. The fabric article of claim 43, wherein said electrical resistance heating filament comprises at least one metal filament wrapped helically about said core.

48. The fabric article of claim 47, wherein said electrical resistance heating filament comprises at least three metal filaments wrapped helically about said core.

49. The fabric article of claim 47, wherein said at least one metal filament of said electrical resistance heating element is formed of stainless steel.

50. The fabric article of claim 43, wherein said electrical resistance heating element has electrical resistance in the range of about 0.1 ohm/cm to about 500 ohm/cm.

51. The fabric article of claim 50, wherein said electrical resistance heating element has electrical resistance of about 1.9 ohm/cm.

52. The fabric article of claim 43, wherein said sheath material comprises yarn wrapped about said electrical resistance heating filament and said core.

53. The fabric article of claim 52, wherein said sheath material comprises a yarn of synthetic material.

54. The fabric article of claim 53, wherein said synthetic material is polyester.

55. The fabric article of claim 53, wherein said synthetic material is nylon.

56. The fabric article of claim 20 or 21, wherein said electrical resistance heating element has the form of a conductive yarn comprising an electrical resistance heating filament and a sheath material generally surrounding said electrical resistance heating filament.

57. The fabric article of claim 56, wherein said electrical resistance heating filament comprises at least one metal filament.

58. The fabric article of claim 56, wherein said electrical resistance heating filament comprises at least three metal filaments.

59. The fabric article of claim 57, wherein said at least one metal filament of said electrical resistance heating element is formed of stainless steel.

60. The fabric article of claim 56, wherein said electrical resistance heating element has electrical resistance in the range of about 0.1 ohm/cm to about 500 ohm/cm.

61. The fabric article of claim 56, wherein said electrical resistance heating element has electrical resistance of about 1.9 ohm/cm.

62. The fabric article of claim 56, wherein said sheath material comprises yarn wrapped about said electrical resistance heating filament.

63. The fabric article of claim 62, wherein said sheath material comprises a yarn of synthetic material.

64. The fabric article of claim 63, wherein said synthetic material is polyester.

65. The fabric article of claim 63, wherein said synthetic material is nylon.

66. The fabric article of claim 20 or 21, wherein said electrical resistance heating element has the form of a conductive yarn comprising a core of insulating material and an electrical resistance heating filament disposed generally about said core.

67. The fabric article of claim 66, wherein said core comprises a yarn of synthetic material.

68. The fabric article of claim 67, wherein said synthetic material is polyester.

69. The fabric article of claim 67, wherein said synthetic material is nylon.

70. The fabric article of claim 66, wherein said electrical resistance heating element comprises at least one metal filament.

71. The fabric article of claim 70, wherein said electrical resistance heating filament comprises at least three metal filaments.

72. The fabric article of claim 70, wherein said at least one metal filament of said electrical resistance heating element is formed of stainless steel.

73. The fabric article of claim 66, wherein said electrical resistance heating element has electrical resistance in the range of about 0.1 ohm/cm to about 500 ohm/cm.

74. The fabric article of claim 67, wherein said electrical resistance heating element has electrical resistance of about 1.9 ohm/cm.

75. The fabric article of claim 67, wherein said electrical resistance heating element has electrical resistance of about 2.5 ohm/cm.

76. The fabric article of claim 20 or 21, wherein said electrical resistance heating element has the form of a conductive yarn comprising an electrical resistance heating filament.

77. The fabric article of claim 76, wherein said electrical resistance heating filament comprises at least one metal filament.

78. The fabric article of claim 76, wherein said electrical resistance heating filament comprises at least three metal filaments.

79. The fabric article of claim 77, wherein said at least one metal filament of said electrical resistance heating element is formed of stainless steel.

80. The fabric article of claim 76, wherein said electrical resistance heating element has electrical resistance in the range of about 0.1 ohm/cm to about 500 ohm/cm.

81. The fabric article of claim 76, wherein said electrical resistance heating element has electrical resistance of about 1.9 ohm/cm.

82. The fabric article of claim 76, wherein said electrical resistance heating element has electrical resistance of about 2.5 ohm/cm.

* * * * *